United States Patent [19]

Taylor

[11] Patent Number: 4,745,762

[45] Date of Patent: May 24, 1988

[54] METHOD AND APPARATUS FOR COOLING OR FREEZING

[75] Inventor: Robert I. Taylor, Epsom, England

[73] Assignee: The BOC Group, PLC, Windlesham, England

[21] Appl. No.: 752,348

[22] Filed: Jul. 3, 1985

[30] Foreign Application Priority Data

Jul. 5, 1984 [GB] United Kingdom ..... 8417120

[51] Int. Cl.[4] ..... F25D 13/06

[52] U.S. Cl. ..... 62/63; 62/177; 62/374; 62/380; 53/493; 198/855; 236/15 BC; 358/101

[58] Field of Search ..... 236/15 BC; 62/63, 374, 62/375, 380, 177; 432/8, 37, 43, 45, 59; 358/101, 107; 198/460, 572, 855; 53/127, 493, 501

[56] References Cited

U.S. PATENT DOCUMENTS

| | | | |
|---|---|---|---|
| 3,532,807 | 10/1970 | Webb | 358/101 |
| 3,733,848 | 5/1973 | Duron et al. | 62/381 |
| 4,118,179 | 10/1978 | Ballinger | 432/59 |
| 4,135,346 | 1/1979 | Rebsamen | 198/572 |
| 4,386,504 | 6/1983 | Brautigam | 62/380 |
| 4,394,896 | 7/1983 | McComas et al. | 198/572 |
| 4,473,842 | 9/1984 | Suzuki et al. | 358/107 |
| 4,581,632 | 4/1986 | Davis et al. | 358/101 |

*Primary Examiner*—Ronald C. Capossela

*Attorney, Agent, or Firm*—David A. Draegert; Larry R. Cassett

[57] ABSTRACT

A video camera or other scanning device is employed to monitor the loading with articles to be frozen of an endless belt which passes through a freezing apparatus so as to freeze such articles typically by contact with liquid nitrogen or its cold vapor. The video camera is associated with electronic circuits that generate a signal representative of the belt loading and compare it with a signal representative of an optimum belt loading. If the difference between the signals is greater than a chosen threshold the belt speed is adjusted so as to reduce or eliminate the difference. By this means an improvement is made possible in the efficiency with which the liquid nitrogen is utilized.

17 Claims, 3 Drawing Sheets

METHOD AND APPARATUS FOR COOLING OR FREEZING

This invention relates to a method and apparatus for cooling or freezing. In particular, it is concerned with the control of the kind of cooling or freezing apparatus capable of being fed continuously with articles (typically food products) to be cooled or frozen, the articles being advanced on a conveyor belt (or the like) through a housing and being typically cooled or frozen by being sprayed or otherwise contacted with a cold vaporisable liquid refrigerant such as liquid nitrogen that vaporises on contact with the articles, the so formed vapour being vented. In order to make the best use of the cold of the refrigerant, the cold vapour is typically heat exchanged with articles to be sprayed with the liquefied gas such as liquid nitrogen before being vented. Examples of such cooling or freezing apparatus are tunnels in which the belt carries the articles to be frozen along a rectilinear path and so-called spiral freezers in which the articles to be cooled or frozen are conveyed along a helical path.

In the example of a freezing tunnel, a temperature sensor is typically located within the tunnel to sense the temperature of the atmosphere therein at a chosen location and the spraying of liquid nitrogen into the tunnel is controlled by means of signals generated by the temperature sensor so as to keep the sensed temperature close to a chosen value. This value is selected to be that necessary in practice for the products to leave the tunnel at a chosen temperature. In order to make efficient use of the liquid nitrogen, or other liquefied gas, it is desirable for the belt to be relatively fully loaded (e.g. in the order of 80% of the upper run of the belt to be covered by articles to be cooled or frozen) so as to maximise the proportion of the enthaply of evaporation of the cryogenic liquid that is used in cooling the articles directly rather than indirectly. Moreover, in the event that mesh belts (or other kinds of belt that allow the liquefied gas to pass therethrough) are used, it is particularly desirable to limit the proportion of the upper run of the belt that is presented to the sprays of liquid nitrogen, since otherwise appreciable quantities of liquid nitrogen will pass through the upper belt run. If these quantities of liquid nitrogen are not collected in trays or the like through which the belt passes, they tend to flow out of the tunnel or to a part of it where their refrigeration cannot be usefully or effectively employed. There is also a maximum belt loading which can be tolerated (such maximum loading generally being the optimum loading as well). The maximum belt loading will be determined by such factors as whether or not articles to be frozen can be permitted to be in contact with one another. For example, in the freezing of certain food products, such contact may be undesirable as it can lead to the products being frozen together or to inadequate cooling at the point of contact.

It can thus be appreciated that for a given belt speed there is an optimum rate of loading products onto the belt. Accordingly, a variable speed belt drive is typically employed and on setting up the tunnel for regular industrial or commercial use a belt speed is selected to facilitate the operator to achieve such an optimum belt loading.

Our experience over a number of years of providing such tunnels particularly for use in freezing foodstuffs is that although on setting up the tunnel a relatively efficient use of liquid nitrogen is made possible (in terms of mass of liquid nitrogen used to freeze a unit mass of food product), the user of the tunnel may from time-to-time make fundamental changes in his production practice which alters the rate at which products are loaded onto the belt. This frequently causes the belt either to be relatively underloaded and in consequence the efficiency with which the liquid nitrogen is used in terms of the mass of liquid nitrogen consumed per unit mass of food product frozen is reduced, or to be relatively overloaded thereby causing some food items to be frozen together.

In spiral freezers, whereas the inefficiencies involved in under loading the conveyor are not so pronounced as in tunnels, there is a maximum permissible loading which is markedly less than 100% of the load-carrying surface area of the belt and which is determined by the fact that the length of the belt reduces owing to its articulated construction.

It is an aim of the present invention to provide a method of cooling or freezing articles in such a cooling or freezing apparatus, and apparatus itself, which makes it possible for the above described problems to be eliminated or ameliorated and an optimum belt loading to be achieved.

In its broadest aspect the invention provides a method of operating a cooling or freezing apparatus including a conveyor belt capable of being loaded continuously and of the above described kind in which a chosen part of the surface area along which the belt travels during its run is monitored, instantaneous signals representative of the proportion of the belt in such surface area that is covered (or not covered) by said articles are generated, and the speed of travel of the belt is adjusted as necessary in response to said signals or integrals thereof in order to correlate the belt speed with the rate of feeding articles onto the belt and thereby keeping the loading at or near to an optimum loading.

Accordingly, the invention provides a method of cooling or freezing articles in a cooling or freezing apparatus capable of being fed continuously with articles to be cooled or frozen, having an endless belt for conveying the articles through the tunnel, means for introducing liquefied gas into the apparatus such that it or its cold vapour (or both) comes into contact with the articles to be frozen, and means for creating a flow of cold vapour (evolved by said liquefied gas) in contact with articles to be cooled or frozen, including the steps of loading articles to be cooled or frozen onto the belt, monitoring a chosen part of the surface area along which the laden belt travels and detecting what proportion of the belt in such surface (or a portion thereof) is covered or not covered by articles, generating instantaneous signals representative of said proportion, and in the event that said proportion diverges by at least a predetermined amount from that desired, adjusting the belt speed in response to said signals (or integrals thereof) so as to reduce or eliminate the divergence.

The invention also provides a cooling or freezing apparatus capable of being fed continously with articles to be cooled or frozen, including an endless conveyor belt, means for driving the said belt, means for contacting articles to be cooled or frozen on said belt in said apparatus with a liquefied gas, or its cold vapour (or both), means for creating a flow of cold vapour evolved from the liquefied gas so as to cool said articles to be frozen, means for monitoring a chosen part of the surface area along which the laden belt travels, means for detecting what proportion of the belt in said surface (or a portion thereof) is covered or not covered by articles, means for generating instantaneous signals representative of said proportion, and aeans for adjusting the speed of travel of the belt in response to such signals (or integrals thereof) in the event that said proportion diverges by at least a predetermined amount from that desired so as to reduce or eliminate the divergence.

In preferred embodiments of the invention a scanning device, for example a video camera, is employed to monitor an area in front of the entrance to the apparatus through which the belt continuously advances in operation. The scanning device is preferably operatively associated with a signal processor which is able to generate an instantaneous signal representative of said proportion. If desired, the instantaneous signals may be integrated over a chosen period of time by an integrator capable of producing a digital or analogue output. Although it is possible to adjust the belt speed manually in response to the instantaneous signals or integrals thereof, it is preferred to effect such adjustments automatically. Typically, each instantaneous signal or each integral of instantaneous signals is compared electronically with a signal representative of the optimum proportion and in the event that the difference therebetween is of a magnitude greater than a chosen threshold, a signal effective to adjust the belt speed is generated. If the belt is relatively underloaded such signal will adjust the belt drive means so as to slow down the belt. Accordingly, assuming that the rate of feeding articles onto the belt is substantially constant, by slowing down the belt the proportion of the surface area on the upper run of the belt covered articles will increase. Analogously, if the belt is by found to be overloaded, the belt speed is increased.

Typically, the apparatus according to the invention include means for monitoring the temperature of the atmosphere therein at a chosen location, and employs a signal generated by such means to control the introduction of liquified gas into the tunnel. This temperature is preferably set at a chosen value and deviations from the chosen value are used to diminish or increase the rate at which liquefied gas is introduced (typically by spraying) into the apparatus (typically a freezing tunnel). In a preferred embodiment of the method and apparatus according to the invention, the chosen or set control temperature is adjusted in accordance with the belt speed. Thus, the slower the belt speed and hence the longer the residence time of the articles in the tunnel, the higher is the chosen temperature; while the faster the belt speed, and hence the shorter the residence time of the articles in the tunnel, the lower the chosen or set temperature. Such adjustment is preferably effected automatically.

By adjusting the belt speed as necessary in accordance with the invention so as to maintain the actual belt loading at or close to an optimum belt loading, and, in preferred embodiments of the invention, by adjusting the chosen or set control temperature in accordance with the belt speed, the efficiency with which the liquefied gas is used be may maintained substantially unimpaired in the event that changes or fluctuations take place in the rate at which articles are fed onto belt.

The method and apparatus according to the invention will now be described by way of example with reference to the accompanying drawings, of which:

Figure 1:
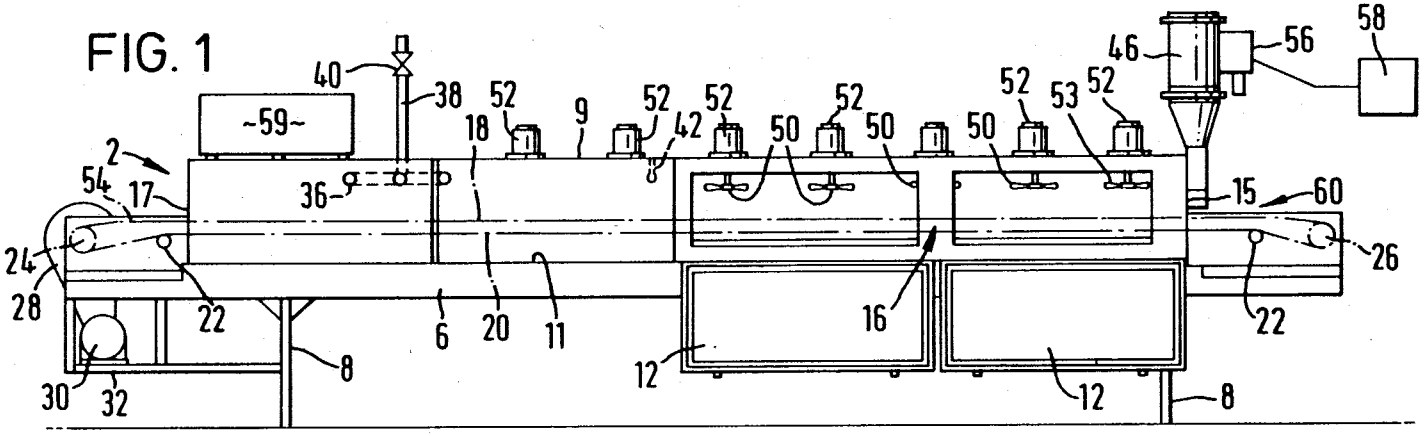
FIG. 1 is a schematic side elevation of a freezing tunnel for freezing food products.
Figure 2:
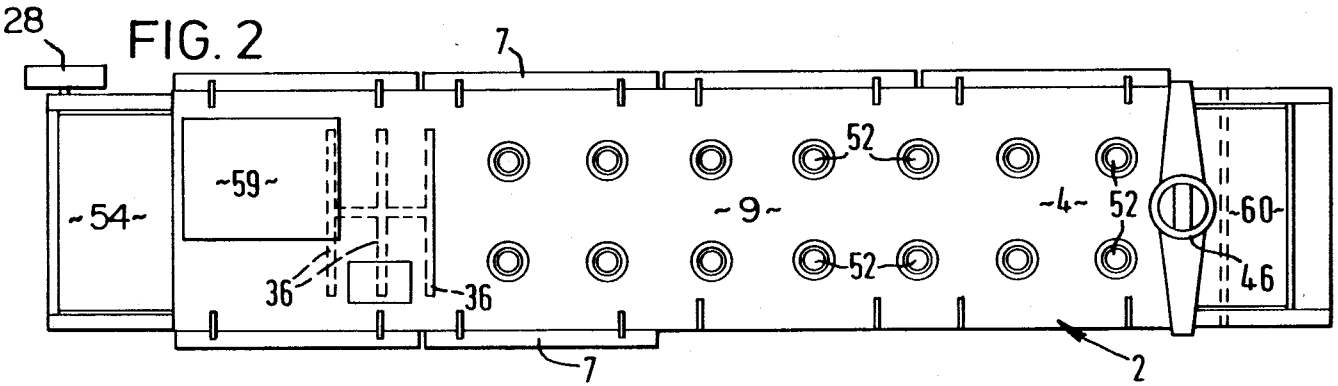
FIG. 2 is a schematic plan view of the tunnel shown in FIG. 1.

Referring to FIGS. 1 and 2 of the accompanying drawings, a freezing tunnel 2 has a housing 4 comprising a pair of spaced apart vertical walls 7 and a flat roof 9 extending generally parallel to a floor 11. The floor 11 is supported on the load bearing surface of a table 6 and 8. Since the tunnel 2 is intended to be used with a cryogenic liquid such as liquid nitrogen, the walls 7, roof 9 and floor 11 are typically formed with inner and outer skins enclosing therebetween suitable thermal insulation. In this way, the influx of heat into the tunnel through the walls 7, roof 9 and floor 11 can be kept to tolerable levels. The walls 7 each comprise a row of rectangular panels 12 which are hinged at the bottom to enable access to be gained to the interior of the tunnel therethrough for the purposes of cleaning and maintenance. As shown in FIG. 1, two of the panels 12 are shown hanging downwards from their respective hinges (not shown).

The tunnel has an entrance 15 and and exit 17. An endless belt 16 extends from the entrance 15 to exit 17 of the tunnel and at any instant of its operation has, as shown, an upper run 18 and a lower run 20. Guide rollers 22 are provided for the belt 16. The belt extends around a driven wheel 24 and an idler wheel 26. The wheel 24 is driven by means of an electric motor 30, transmission being through a belt 28. The motor 30 is mounted on a frame 32 which is welded or otherwise attached to the table 6.

Three spray devices 36 are located within the tunnel 2 relatively near to its exit 17 and surmount the belt 16. Each spray device 36 is in communication with an insulated pipe 38 which in turn communicates with a source of liquid nitrogen (not shown). An automatic flow control valve 40 is disposed along the pipe 38. The valve 40 is operatively associated with a temperature sensor 42 located in the space above the belt at a chosen location within the tunnel 2 intermediate its entrance 15 and the spray device 36. Each spray device 36 has a width approximately corresponding to the width of the belt 16 and is mounted directly over the upper run 18 of the belt 16. Each spray device 36 is also provided with a row of orifices (not shown) through which liquid nitrogen can be sprayed in operation of the tunnel 2. Each such orifice faces downwards such that in operation the spray of liquid nitrogen is directed downwards onto the belt 16 or any food product or other article interposed between the upper run 18 of the belt and the spray devices 36. Typically, the belt 16 may be of a meshed or slatted construction.

In operation, articles of substantially uniform size, shape and mass to be frozen and at ambient temperature are loaded onto the belt and are transported thereby through the tunnel. Liquid nitrogen (at a temperature of −196° C.) is sprayed onto the surface of food articles being transported through the tunnel as such articles pass directly under the spray headers 36, and cools such articles by giving up to the mits enthalpy of evaporation. The resultant cold nitrogen vapour is then employed to precool the food products as they are being transported to a region directly underneath the spray headers 36. To this end, one or more axial fans 53 are employed to create a flow of cold nitrogen vapour through the tunnel countercurrent to the direction of passage of food products therethrough and in the general direction of the entrance 15 of the tunnel. The fans 53 are associated with an exhaust stack 46 through which the gas is drawn and exhausted to the environment. It is important that the cold nitrogen be exhausted to a well ventilated region outside the tunnel 2 so as to avoid any risk of creating a dangerously high nitrogen concentration in an area where people are working. As the cold nitrogen flows along the tunnel 2 countercurrently to the food products, so the food products give up heat thereto and the nitrogen is progressively warmed. Moreover, by employing an open belt 16, for example, formed of steel mesh, some of the cold nitrogen will flow under the upper run 18 and thereby provide cooling for the under surface of the food products not directly contacted by the liquid nitrogen sprayed into the tunnel from the spray headers 36. In, for example, the freezing of hamburger patties, it might be desired to reduce the temperature of the incoming patties from ambient to a temperature well below freezing (e.g. −18° C.). Typically, the temperature control arrangement may be such that if the sensed gas temperature rises above −100° C. the setting of the valve 38 is automatically changed so as to increase the rate at which liquid nitrogen is sprayed into the tunnel, thereby reducing the operating temperature of the tunnel. If the temperature falls below −100° C. the setting of the valves is automatically adjusted so as to decrease the rate at which liquid nitrogen is sprayed into the tunnel. Thus, a gas temperature as sensed by the sensor 42 in the order of −100° C. can be maintained throughout the operation of the tunnel.

It is to be appreciated that the temperature of −100° C. is selected having regard to the belt speed and the desired final temperature of the food products and the belt loading.

In order to facilitate heat exchange between the cold nitrogen and the food products to be contacted with liquid nitrogen, a plurality of fans adapted to create turbulence within the cold nitrogen in the tunnel are mounted over the upper belt run 18 intermediate the entrance 15 and the spray headers 36. Typically twelve to forty eight fans 50 may be employed, these fans being arranged and operated in the manner described in our U.K. patent specification No. 1 251 998. Each fan 50 is provided with its own electric motor 52 mounted outside the tunnel on top of its roof 9. Similarly, each fan 53 is provided with its own motor 52.

In operation, food products to be frozen are loaded at a substantially constant rate by hand or automatically onto the upper run of the belt at the loading location 60, it being appreciated that the arrangement of the belt 16 relative to the housing 4 of the tunnel is such that adequate spaces for loading at the location 60 and unloading at the location 54 are left.

The belt speed, loading rate and temperature control are all arranged so as to obtain a very good, if not optimum, utilisation of refrigerative capacity of liquid nitrogen sprayed into the tunnel 2.

In accordance with the invention, a loading area 60 is monitored by means of a video camera 56 which provides on the screen 58 a television picture of part of the area over which travels the upper belt 18. It is important that the signal transmitted by the camera 56 enables the belt to be distinguished from a food product. Typically, the belt will be covered by white ice as a result of the cold nitrogen freezing moisture evolved from the food products being frozen or present in the atmosphere within the tunnel. Thus, if the food product is itself white, it will be difficult to distinguish an area of the belt surface covered by food product from an area not so covered. Accordingly, we prefer to employ a camera sensitive to infra red radiation. By this means, the relatively cold belt will give a substantially different signal from the relatively warm food products being loaded onto the belt. It is therefore possible to generate a signal representative of that proportion which is covered or uncovered all or part of the scanned surface area. A resulting signal is received by a control box 59 and is used to control the speed of the belt 16 to enable it to compensate automatically for the changes in the rate at which food products are loaded onto the belt and thereby the apparatus shown in FIG. 1 and 2 makes it possible to maintain a favourable belt loading even though changes in such feed rate of articles onto the belt may periodically take place. The manner in which this result may be achieved is described in more detail with reference to FIG. 3 of the accompanying drawings.

An electronic signal processor 62 analyses or processes the signal generated by the camera 56 (typically by individual analysis of each pixel to determine whether each pixel is relatively light or relatively dark) and produces an instantaneous signal representative of the proportion of the monitored surface area (or chosen portion thereof) covered by food articles to be frozen. Alternatively a signal representative of the uncovered proportion of the surface area or chosen portion thereof can be generated. The instantaneous signals are fed from the signal processor 62 to an integrator 64. The integrator integrates the signals over a chosen time period and produces a digital or analogue output. The period of time over which the integration of the instantaneous signals from the processor 62 takes place will depend on the size of the surface area processed by the signal processor 62. If the surface area so processed is substantially linear, then integration over a relatively long period, say up to 30 seconds, may be desirable so as to avoid misleading signals being generated. For example, suppose the optimum belt loading is 80% (that is 80% of the load bearing surface area is covered by food products to be frozen) a line across the belt may from time to time be totally bare. The integration must take place over a period of time sufficient for a fully representative set of instantaneous signals to be generated. On the other hand, if a relatively wide band of the belt is monitored and the signal from the camera over the whole of this band is processed by the signal processor 62, the integration may be over a relatively short time period, say a few seconds or indeed there may be no need to employ an integrator at all. The output from the integrator 64 is passed to a comparator 66 which compares the output electronically with a signal representative of the desired optimum loading. The signal is generated by a programmable central processing unit 68. As a result of this electronic comparison, a signal is returned to the central processing unit 68 and this signal is employed to adjust the set point of a belt speed controller 70 operatively associated with the motor 30 of the belt of the freezing tunnel. The belt speed controller 70 includes electronic circuits sensing the belt speed or the RPM of the motor driving belt and maintaning the belt speed at a chosen "set point" value. A signal representative of the actual belt speed or RPM of the motor is passed back to the central processing unit 68 which employs the signal from the comparator 66, to provide where the loading of the belt deviates by a predetermined amount from the optimum, a signal effective to adjust the belt speed so as to tend to change the loading towards the optimum. Thus, if the belt is being underloaded, the belt speed is reduced whereas if it is being overloaded, its speed is increased.

Figure 3:
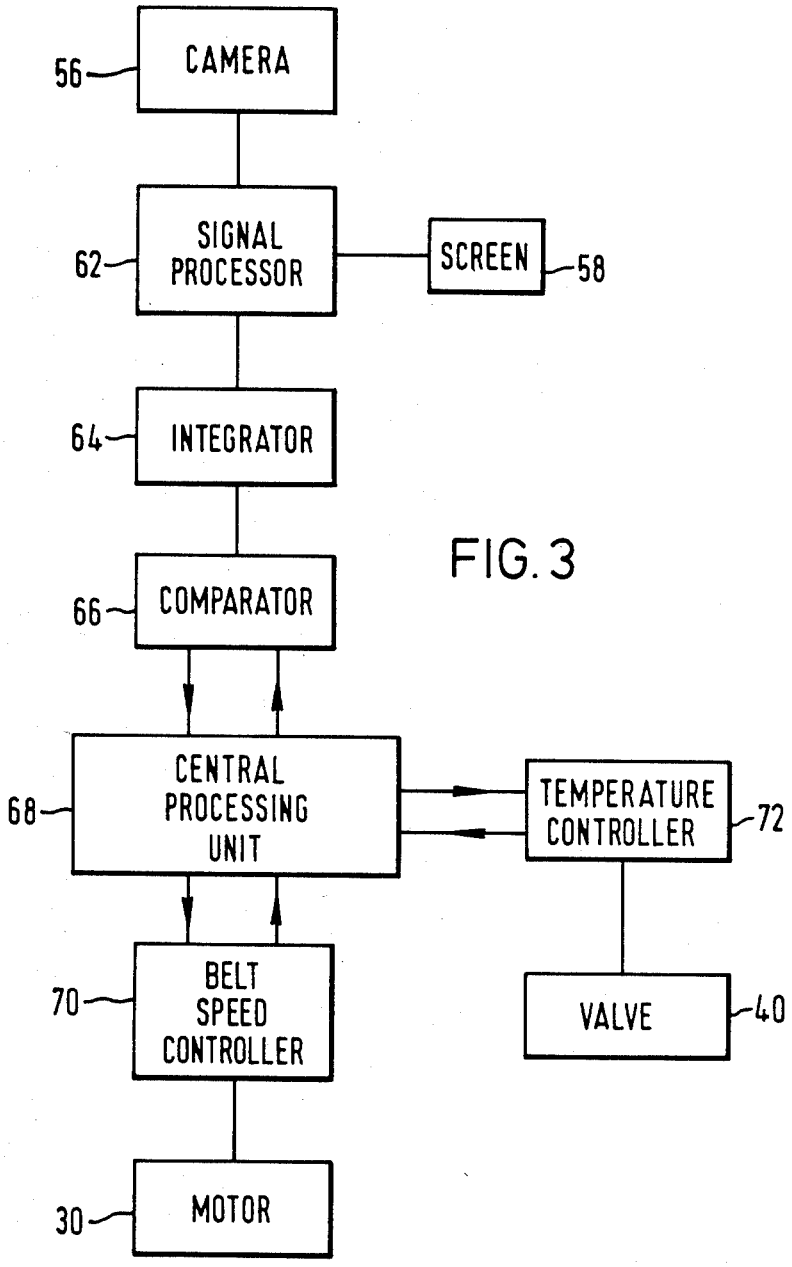
FIG. 3 is a schematic representation of control circuits for use in conjunction with the tunnel shown in FIGS. 1 and 2.

The apparatus shown in FIG. 3 also has means for adjusting the set point temperature sensed by the temperature sensor 42 in the tunnel in accordance with the belt speed. Generally, the slower the belt speed, the longer the residence time of the articles to be frozen in the tunnel and hence a relatively higher sensed temperature will be the optimum. On the other hand, the faster the belt speed, the less the residence time of the articles to be frozen in the tunnel and thus the relatively lower the set point temperature needs to be. The temperature sensor 42 is associated with a temperature controller 72 which maintains the temperature at a chosen set point. This is done by using the temperature controller 72 to generate signals effective to adjust the setting of the control valve 40 controlling the flow of liquid nitrogen into the tunnel. The arrangement is such that should the temperature sensor sense a temperature below the set point, then the position of the control valve is adjusted to reduce the flow of liquid nitrogen into the tunnel. Conversely, should the temperature sensor show a temperature above the set point the temperature controller 72 adjusts the control valve 40 so as to increase the flow of liquid nitrogen in to the tunnel thereby bringing the sensor temperature back to the set point temperature. The set point temperature of the temperature controller 72 is capable of being adjusted by means of a signal from the central processing unit 68. This central processing unit 68 receives a signal of the actual set point temperature from the temperature controller 72 and employs this signal and provides an adjustment signal to change the set point in accordance with the belt speed so as to obtain the optimum use of liquid nitrogen in a manner described herein above.

The belt speed controller 70 and the temperature controller 72 receive information distributely from the control processing unit 68 and are therefore able to function in the event of failure or nonuse of the central processing unit 68.

In the event that the user of the tunnel wishes to use the tunnel to refrigerate batches of different products at different times the above described control system may be programmed for each kind of food product to be refrigerated or frozen and manual selection means can be provided for switching in the appropriate programne or programmes.

It is to be appreciated that those parts of the tunnel that are to come into contact with cryogenic liquid or its cold vapour are formed of materials that are able satisfactorily to withstand low temperatures. The electronic circuits included in the apparatus shown in FIG. 3 are all of standard type.

If desired, more than one separate area may be scanned. A primary signal may be generated by virtue of a scan of a relatively small surface area. This signal may be used to provide primary control of the belt speed. A secondary signal may then be generated by virtue of a scan of a larger surface area. This signal may be used to provide an adjustment signal to provide closer control of the belt speed.

Figure 4:
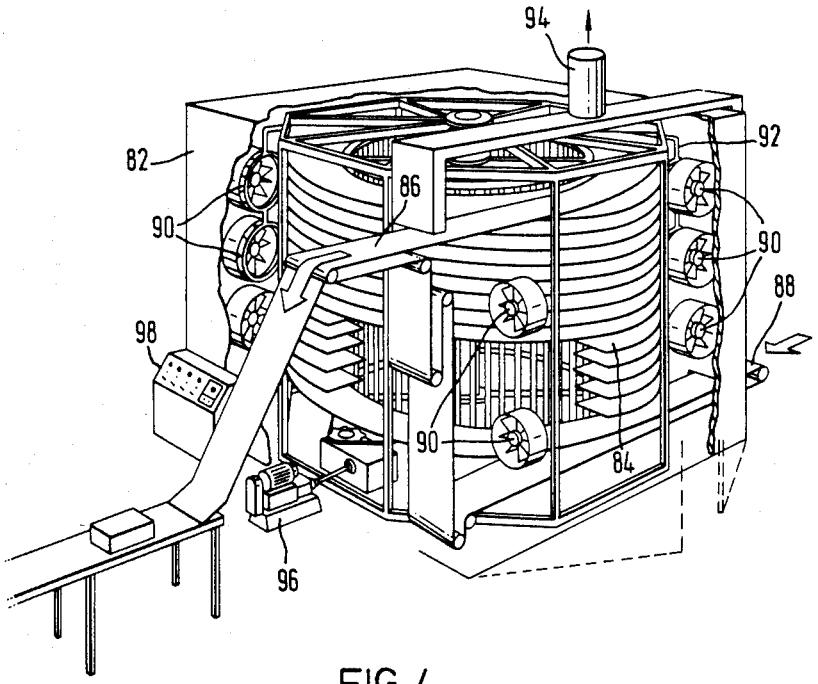
FIG. 4 is a schematic perspective view of a spiral freezer suitable for operation in accordance with the invention.

The control system illustrated in FIG. 3 may also be employed to control the loading at the product inlet end of a spiral freezer in a wholly analogous manner. The spiral freezer is illustrated in FIG. 4. It is of the conventional type and shall be described only briefly herein. The freezer has an insulated housing 82 which and endless belt 84 is disposed in the manner of a helix. The upper belt run travels from the bottom of the housing generally along a helical path to a product exit point 86 near the top of the housing. Parts may thus be loaded onto the belt at the product inlet end 88 and carried along the helical path and then discharged from the belt at the exit 86. In order to provide the necessary refrigeration to freeze these products, an arrangement of fans 90 and liquid nitrogen spray pipes 92 is provided so as to circulate cold nitrogen vapour across the load on the belt along the entire extent of its proper run. There is an exhaust system 94 for extracting used nitrogen vapour from the top of the housing 82.

The belt is driven by a drive unit 96. Introducing of liquid nitrogen into the tunnel is controlled by an appropriate valve operatively associated with a temperature sensor and a control console 98. In operation of the sprial freezer in accordance with the invention, the control in FIG. 3 is employed, the camera 56 being mounted over the product inlet 88. A visual indication of the Toading of the belt may be given on the screen 58 which may be mounted in any convenient location.

I claim:

1. A method of cooling or freezing articles in an apparatus capable of being fed continuously with articles to be cooled or frozen, including the steps of loading articles onto an endless belt, conveying the articles through the apparatus, introducing liquefied gas into the apparatus such that it or its cold vapour, or both, comes into contact with the articles, and creating a flow of cold vapour, evolved by sad liquefied gas, in contact with the articles, the improvement comprising the steps of monitoring a chosen part of the surface area along which the laden belt travels, detecting what proportion of the belt in such surface, or a portion thereof, is covered or not covered by articles, generating signals representative of said proportion, comparing said signals with a desired amount, and, in the event that said proportion diverges from that desired, adjusting the belt speed in response to said signals so as to reduce or eliminate the divergence.

2. A method as claimed in claim 1, in which the monitoring step comprises scanning an area in front of the entrance to the apparatus through which the belt continuously advances, the detecting step comprises distinguishing laden parts of the belt from unladen parts in such area, and the generating step comprises generating an instantaneous signal representative of said proportion.

3. A method as claimed in claim 2, wherein the instananeous signals are compared electronically with a signal representative of the optimum loading for the belt surface, and, in the event that the difference therebetween is of a magnitude greater than a chosen threshold, generating a signal effective to adjust the belt speed.

4. A method as claimed in claim 2, further comprising integrating the instantaneous signals over a chosen period of time, and wherein the integrated signals are compared electronically with a signal representative of the optimum loading for the belt surface, and, in the event that the difference therebetween is of a magnitude greater than a chosen threshold, generating a signal effective to adjust the belt speed.

5. A method as claimed in claim 1, further comprising comparing the temperature of the atmosphere in the apparatus with a chosen but adjustable value, using deviations from the chosen value to diminish or increase the rate at which liquefied gas is introduced into the apparatus, and adjusting said chosen value in accordance with changes in the belt speed so as to maintain the efficiency with which the liquefied gas is used.

6. A cooling or freezing apparatus capable of being fed continuously with articles to be cooled or frozen, including an endless conveyor belt, means for driving the belt, means for contracting articles on said belt with a liquefied gas, or its cold vapour, or both, means for creating a flow of cold vapour evolved from the liquefied gas so as to cool said articles, means for monitoring a chosen part of the surface area along which the laden belt travels, means for detecting what proportion of the belt in said surface, or a portion thereof, is covered or not covered by articles, means for generating signals representative of said proportion, means for comparing said signals with a desired amount, and means for adjusting the speed of travel of the belt in response to such signals so as to reduce or eliminate the divergence in the event that said proportion diverges from that desired.

7. Apparatus as claimed in claim 6, in which said monitoring means is a scanning device.

8. Apparatus as claimed in claim 7, in which the scanning device is positioned to be able to monitor an area in front of the entrance to the apparatus through which the belt continuously advances in operation of the apparatus.

9. Apparatus as claimed in claim 7, in which said scanning device is a video camera.

10. Apparatus as claimed in claim 7, in which said scanning device is sensitive to infra-red radiation.

11. Apparatus as claimed in claim 7, wherein an electronic signal processor is operatively associated with the scanning device for generating an instantaneous signal representative of said proportion, for comparing electronically said instantaneous signals with a signal representative of a chosen proportion of the belt surface, and for generating a signal effective to adjust the belt speed in the event that the difference therebetween is greater than a chosen threshold, whereby to reduce or eliminate said difference.

12. Apparatus as claimed in claim 7, wherein an electronic signal processor is operatively associated with the scanning device for generating an instantaneous signal representative of said proportion, for integrating instantaneous signals generated over a period of time, for comparing electronically said integrated signals with a signal representative of a chosen proportion of the belt surface, and for generating a signal effective to adjust the belt speed in the event that the difference therebetween is greater than a chosen threshold, whereby to reduce or eliminate said difference.

13. Apparatus as claimed in claim 6, additionally including means for monitoring the temperature of the atmosphere therein at a chosen location, means for maintaining said temperature at a set value, and means for adjusting the set temperature in accordance with the belt speed, whereby to maintain substantially unimpaired the efficiency with which the liquefied gas is used in the apparatus.

14. A freezing tunnel capable of being fed continuously with articles to be frozen, including an endless conveyor belt, means for driving the belt, means for contacting articles on said belt with a liquefied gas, or its cold vapour, or both, means for creating a flow of cold vapour evolved from the liquefied gas so as to cool said articles, means for monitoring a chosen part of the surface area along which the laden belt travels, means for detecting what proportion of the belt in said surface, or a portion thereof, is covered or not covered by articles, means for generating signals representative of said proportion, means for comparing said signals with a desired amount, and means for adjusting the speed of travel of the belt in response to such signals so as to reduce or eliminate the divergence in the event that said proportion diverges by at least a predetermined amount from that desired.

15. The apparatus as claimed in claim 14 wherein the monitoring means is a video camera sensitive to infrared radiation.

16. The apparatus as claimed in claim 15 wherein the video camera is positioned to be able to monitor an area in front of the entrance to the apparatus through which the belt continuously advances in operation of the apparatus.

17. The apparatus as claimed in claim 16, additionally including means for monitoring the temperature of the atmosphere therein at a chosen location, means for maintaining said temperature at a set value, and means for adjusting the set temperature in accordance with the belt speed, whereby to maintain substantially unimpaired the ufficiency with which the liquefied gas is used in the apparatus.

* * * * *